US011398683B2

(12) United States Patent
Adams et al.

(10) Patent No.: US 11,398,683 B2
(45) Date of Patent: Jul. 26, 2022

(54) PERIMETER-FED ARRAY

(71) Applicant: THE BOEING COMPANY, Chicago, IL (US)

(72) Inventors: Alec Adams, Seattle, WA (US); Lixin Cai, Ravensdale, WA (US)

(73) Assignee: The Boeing Company, Chicago, IL (US)

( * ) Notice: Subject to any disclaimer, the term of this patent is extended or adjusted under 35 U.S.C. 154(b) by 247 days.

(21) Appl. No.: 16/668,520

(22) Filed: Oct. 30, 2019

(65) Prior Publication Data

US 2021/0135372 A1 May 6, 2021

(51) Int. Cl.

| | |
|---|---|
| ***H01Q 13/00*** | (2006.01) |
| ***H01Q 21/06*** | (2006.01) |
| ***H01Q 21/00*** | (2006.01) |
| ***H01Q 13/18*** | (2006.01) |
| ***H01Q 3/34*** | (2006.01) |

(52) U.S. Cl.

CPC ..... *H01Q 21/064* (2013.01); *H01Q 3/34* (2013.01); *H01Q 13/18* (2013.01); *H01Q 21/0006* (2013.01)

(58) Field of Classification Search

CPC .... H01Q 21/064; H01Q 21/0006; H01Q 3/34; H01Q 13/18

See application file for complete search history.

(56) References Cited

U.S. PATENT DOCUMENTS

| | | | |
|---|---|---|---|
| 5,512,906 A | 4/1996 | Speciale | |
| 5,877,729 A | 3/1999 | Holloway et al. | |
| 6,020,858 A * | 2/2000 | Sagisaka | H01Q 21/005 343/770 |
| 6,081,235 A | 6/2000 | Romanofsky et al. | |
| 6,870,517 B1 | 3/2005 | Anderson | |
| 7,081,861 B2 | 7/2006 | Steyn et al. | |
| 7,170,446 B1 | 1/2007 | West et al. | |
| 9,007,254 B2 | 4/2015 | Vangen et al. | |

(Continued)

FOREIGN PATENT DOCUMENTS

| | | |
|---|---|---|
| EP | 322809 A2 | 7/1989 |
| WO | 2019161116 A1 | 8/2019 |

OTHER PUBLICATIONS

Antennas. John D Kraus. 1988.

(Continued)

*Primary Examiner* — Dieu Hien T Duong

(74) *Attorney, Agent, or Firm* — Armstrong Teasdale LLP

(57) ABSTRACT

A phased array antenna includes a resonant cavity, a plurality of feed waveguides, an array of slot antenna elements, and a plurality of phase shifters. The resonant cavity includes a boresight surface having a normal vector oriented with boresight for the phased array antenna. The plurality of feed waveguides is distributed along a perimeter of the resonant cavity and is configured to supply electromagnetic waves to the resonant cavity. The array of slot antenna elements is distributed about the boresight surface and configured to radiate a beam based on standing waves within the resonant cavity. Each of the plurality of phase shifters is respectively coupled with the plurality of feed waveguides and independently controllable to modify the respective phases of the standing waves to steer the beam.

20 Claims, 9 Drawing Sheets

(56) References Cited

U.S. PATENT DOCUMENTS

| | | | |
|---|---|---|---|
| 9,509,060 | B2 | 11/2016 | Faraone et al. |
| 9,843,096 | B2 | 12/2017 | Sanford |
| 2018/0294537 | A1 | 10/2018 | Borysenko |
| 2019/0131705 | A1 | 5/2019 | Syrytsin et al. |
| 2019/0260124 | A1 | 8/2019 | Davoyan et al. |

OTHER PUBLICATIONS

"Visual Illustrations of Microwave Holographic Beamforming using a Modulated Surface-Impedance Metamaterial", Siamak Ebadi, Tom Driscoll, and David Smith, 2013 IEEE, pp. 2343-2344.

"Sidelobe Canceling for Reconfigurable Holographic Metamaterial Antenna" Mikala C. Johnson, Steven L. Brunton, Nathan B. Kundtz and J. Nathan Kutz IEEE Transactions on Antennas and Propagation, vol. 63, No. 4, Apr. 2015, pp. 1881-1886.

* cited by examiner

| Name | Theta | Ang | Mag |
|---|---|---|---|
| m1 | 0.0000 | 0.0000 | 13.2053 |
| m2 | -50.0000 | -50.0000 | -2.1893 |

| Name | Theta | Ang | Mag |
|---|---|---|---|
| m3 | 36.0000 | 36.0000 | 0.6008 |
| m4 | -30.0000 | -30.0000 | 12.2061 |

PERIMETER-FED ARRAY

FIELD

The field of the disclosure relates generally to phased array antennas and, more specifically, to a perimeter-fed array and systems and methods for steering a beam radiated from a phased array antenna.

BACKGROUND

Conventional radar applications utilize "steerable," or directed, beams. Such steering is often accomplished with an electronically steerable, or scanned, antenna as an alternative to traditional mechanically scanned arrays, which are often too large, too expensive, and consume too-much power for certain applications. Electronically steerable antennas generally include a phased array antenna having an array, or grid, of antenna elements spaced according to the operating wavelength for the system. Typically, each antenna element is individually fed a radio frequency (RF) signal that is offset in phase from each other. The phase shift from each antenna element to the next results in a beam radiated in a direction generally characterized by an azimuth angle and an elevation angle, and typically each defined with respect to boresight, which is the direction normal to the surface of the phased array. Accordingly, by enabling each antenna element to be dynamically phase shifted with respect to each other, the radiated beam is steerable. By steering the beam over a range of azimuth and a range of elevation over time, the phased array electronically "scans" that space.

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

BRIEF DESCRIPTION

One aspect of the present disclosure includes a phased array antenna including a resonant cavity, a plurality of feed waveguides, an array of slot antenna elements, and a plurality of phase shifters. The resonant cavity includes a boresight surface having a normal vector oriented with boresight for the phased array antenna. The plurality of feed waveguides is distributed along a perimeter of the resonant cavity and is configured to supply respective electromagnetic waves to the resonant cavity. The array of slot antenna elements is distributed about the boresight surface and configured to radiate a beam based on standing waves within the resonant cavity. Each of the plurality of phase shifters is respectively coupled with the plurality of feed waveguides and independently controllable to modify the respective phases of the standing waves to steer the beam.

Another aspect of the present disclosure includes a method of steering a beam using a phased array antenna. The method includes shifting respective phases of a plurality of electromagnetic waves. The method includes feeding the plurality of Electromagnetic waves at a perimeter of a resonant cavity. The resonant cavity is configured to produce standing waves therein based on the Electromagnetic waves. The method includes radiating a steered beam from an array of slot antenna elements distributed about a boresight surface of the resonant cavity based on the standing waves.

Yet another aspect of the present disclosure includes a system including a phased array antenna, a scanner, and a computing system. The phased array antenna includes a resonant cavity, an array of slot antenna elements, and a plurality of phase shifters. The array of slot antenna elements is distributed about a boresight surface and configured to radiate a beam based on standing waves within the resonant cavity. Each of the plurality of phase shifters is coupled with a corresponding feed waveguide at a perimeter of the phased array antenna. The plurality of phase shifters are each independently controllable to sweep through a range of phases for electromagnetic waves fed to the phased array antenna to steer the beam. The scanner is configured to measure electromagnetic fields within the resonant cavity relative to the array of slot antenna elements for the range of phases. The computing system is in communication with the scanner and is configured to build a look up table relating the range of phases to beam directions corresponding to electromagnetic fields measured by the scanner.

Various refinements exist of the features noted in relation to the above-mentioned aspects. Further features may also be incorporated in the above-mentioned aspects as well. These refinements and additional features may exist individually or in any combination. For instance, various features discussed below in relation to any of the illustrated examples may be incorporated into any of the above-described aspects, alone or in any combination.

Figure 1:
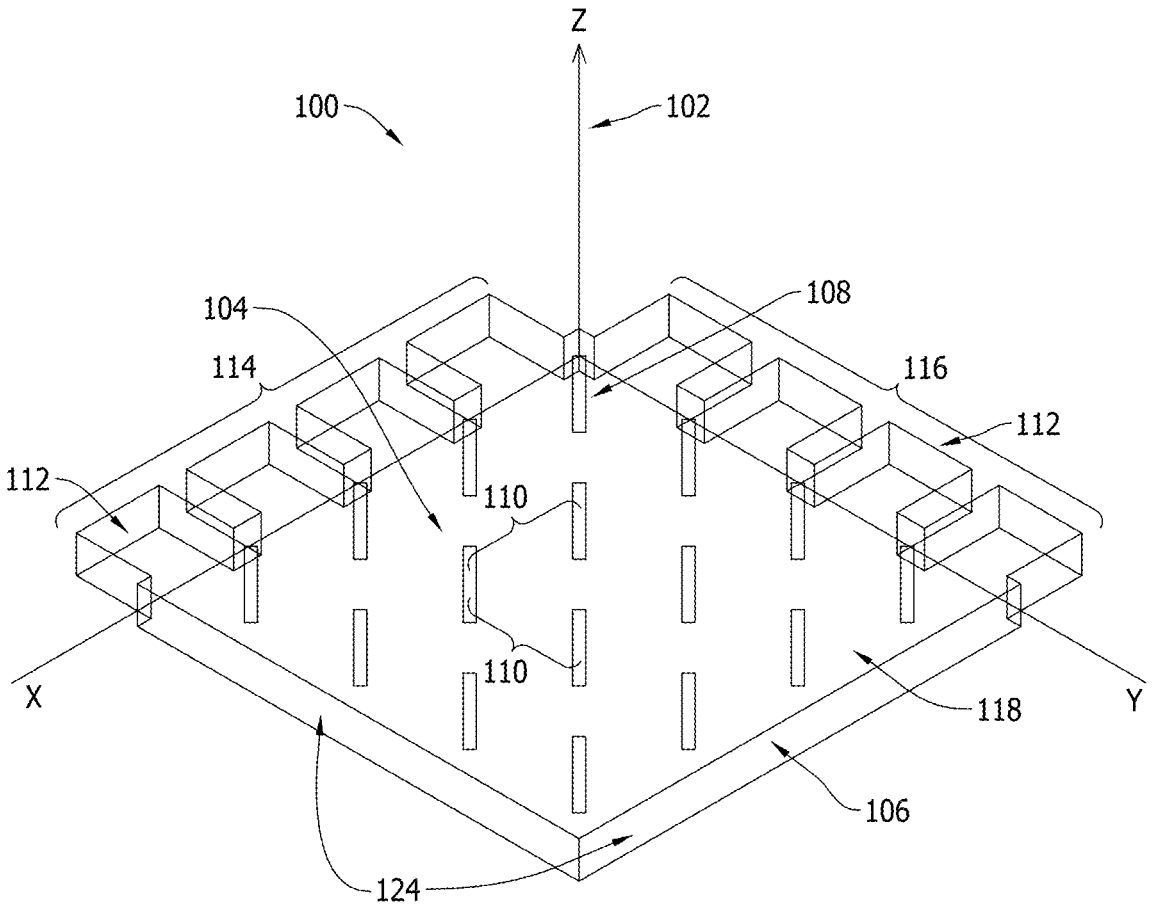
FIG. 1 is a perspective diagram of an example phased array antenna.

Corresponding reference characters indicate corresponding parts throughout the several views of the drawings. Although specific features of various examples may be shown in some drawings and not in others, this is for convenience only. Any feature of any drawing may be referenced and/or claimed in combination with any feature of any other drawing.

DETAILED DESCRIPTION

Embodiments of the systems described herein include a phased array antenna that is perimeter-fed. More specifically, the phased array antenna includes a plurality of slot antenna elements arranged in an array on the boresight surface of the phased array antenna. Behind the boresight surface is a resonant cavity fed at its perimeter by a plurality of feed waveguides, or "feeds." Each row and each column of slot antenna elements in the array is fed by one feed waveguide, and each feed waveguide is coupled with a corresponding phase shifter that is independently controllable. By dynamically controlling the phase shifters, the standing waves within the resonant cavity are shifted, resulting in a steered beam radiated from the array of slot antenna elements. In contrast, a traditional phased array antenna would utilize one phase shifter and one feed per radiating element. For example, an N-by-M array (where N and M are integers greater than one) would utilize N×M phase shifters and feeds at great expense. Embodiments of the phased array antenna described herein would utilize N+M phase shifters and feeds arranged only at the perimeter to steer the beam radiated by the same number of radiating elements, dramatically reducing cost, complexity, and weight of the phased array antenna. The phased array antenna described herein is phase shifter type agnostic and can be easily scaled to higher frequencies, for example, up to K-band frequencies.

Figure 2:
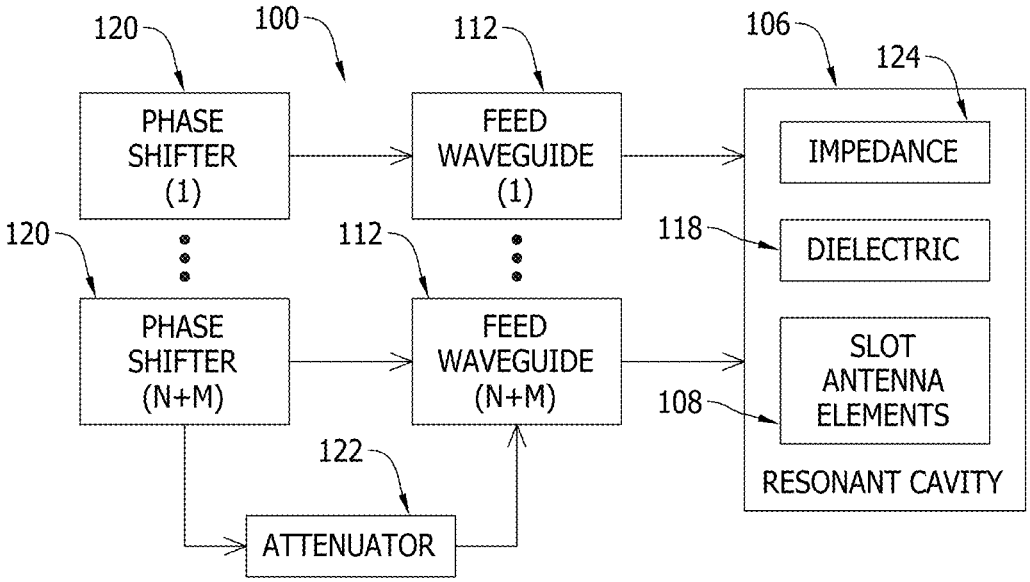
FIG. 2 is a block diagram of the phased array antenna shown in FIG. 1.

FIG. 1 is a perspective diagram of a phased array antenna 100. FIG. 2 is a block diagram of phased array antenna 100 shown in FIG. 1. Phased array antenna 100 radiates a beam (not shown) steered in a direction defined relative to boresight 102, which is represented by a vector extending normal to a boresight surface 104 of phased array antenna 100. Boresight surface 104 forms one boundary of a resonant cavity 106 and includes a plurality of slot antenna elements 108 arranged in an array. Each slot antenna element 108 is spaced from its neighboring slot antenna element 108 according to a wavelength corresponding to the operating frequency of phased array antenna 100. For example, in at least some embodiments, a spacing 110 among slot antenna elements 108 is at most wavelength (lambda) divided by two, or $\lambda/2$. In other embodiments, where greater resolution in beam steering is desired, spacing 110 among slot antenna elements 108 is reduced, and a greater quantity of slot antenna elements 108 is utilized.

Resonant cavity 106 is generally rectangular and dimensioned according to the wavelength, or frequency, of standing waves it will produce in its volume. Resonant cavity 106 is perimeter-fed by a plurality of feed waveguides 112. Accordingly, feed waveguides 112 are distributed along two perimeter sides 114 and 116 of resonant cavity 106, sides 114 and 116 corresponding to the X-axis and the Y-axis, respectively (where boresight corresponds with a Z-axis). Feed waveguides 112 are also dimensioned according to the wavelength, or frequency, of electromagnetic waves that will most-efficiently propagate through their volume (e.g., cross-sectional dimensions decrease and increase with wavelength). Generally, electromagnetic waves are fed to resonant cavity 106 through each of feed waveguides 112, and then reflect variously off the walls of resonant cavity 106. Electromagnetic waves at a resonant frequency for resonant cavity 106 will produce standing waves within resonant cavity 106. These standing waves result in radiation from the plurality of slot antenna elements 108 in boresight surface 104.

Resonant cavity 106 and feed waveguides 112 are filled, or loaded, with a dielectric material, or dielectric, having some defined relative permittivity ($\varepsilon_r$), or dielectric constant. For example, resonant cavity 106 can be filled with air, which has a relative permittivity of 1.0058986, which is only slightly more than that of a vacuum. A dielectric 118 loaded into resonant cavity 106 affects the resonant frequency of resonant cavity 106. For example, in certain embodiments, resonant cavity 106 can be loaded with dielectric 118 having a greater relative permittivity (e.g., silicon dioxide having $\varepsilon_r$=3.9) to reduce the wavelength of the standing waves produced within resonant cavity. In alternative embodiments, dielectric 118 can be any other suitable dielectric material for the application, such as, for example, Rexolite, which has a relative permittivity of 2.53. Accordingly, dielectric 118 enables a reduction in spacing 110 among the plurality of slot antenna elements 108. Likewise, the dielectric within feed waveguides 112 affects the frequency of electromagnetic waves it will propagate.

Phased array antenna 100 includes a plurality of phase shifters 120 (not shown in FIG. 1) respectively coupled with each of feed waveguides 112 to modify the respective phases of the electromagnetic waves fed to resonant cavity 106, and thereby modifying the phases of standing waves produced within resonant cavity 106. Each of phase shifters 120 is independently controllable, for example, by a microcontroller, digital signal processor (DSP), or other processing device (not shown), to dynamically adjust, over time, the phase shift it applies. By adjusting the respective phases of the electromagnetic waves fed to resonant cavity 106 and, consequently, the phases of the standing waves produced therein, phased array antenna 100 enables steering, in azimuth and elevation relative to boresight 102, of the beam radiated by the plurality of slot antenna elements 108.

Phase shifters 120, in certain embodiments, each include a monolithic microwave integrated circuit (MMIC) phase shifter coupled to a respective feed waveguide 112 at a feed-point for feed waveguide 112 itself. A phase-shifted electromagnetic wave then propagates through feed waveguide 112 and into resonant cavity 106. In alternative embodiments, phase shifters 120 can include in-line waveguide phase shifters coupled in series with one or more waveguides that form a given feed waveguide 112. In other alternative embodiments, phase shifters 120 can include any other form of microwave phase shifter that enables independent control of the phase shift applied to each feed to resonant cavity 106.

Phased array antenna 100 includes, generally, an N-by-M array of slot antenna elements 108, where N and M are integers greater than one. Accordingly, the array includes N×M slot antenna elements 108. In FIG. 1, for example, phased array antenna 100 includes a four-by-four array of 16 slot antenna elements 108 (e.g., N and M=4). At least some known phased array antennas having an N-by-M array include an equal number of feeds and phase shifters to achieve effective beam steering. For example, a conventional 4×4 array would utilize 16 feeds and 16 phase shifters. Embodiments of the phased array antennas described herein, for example, phased array antenna 100, utilizes no more than N+M feeds, e.g., feed waveguides 112, and N+M phase shifters 120. In the example of a 4×4 array, phased array antenna 100 utilizes eight feed waveguides 112 and eight phase shifters 120. Similarly, in another example embodiment having a 100×100 array, a conventional implementation would need 10,000 feeds and 10,000 phase shifters. Conversely, embodiments of the phased array antenna described herein would utilize, for example, 200 feed waveguides 112 and 200 phase shifters 120 (i.e., 100+100). Accordingly, the quantity of components, cost, and complexity of phased array antenna 100 is reduced relative to conventional phased array antennas.

In certain embodiments, phased array antenna 100 includes a plurality of attenuators 122 (shown in FIG. 2)

respectively coupled with feed waveguides 112 to control respective amplitudes of the standing waves produced within resonant cavity 106, which further enables control of antenna gain. In certain embodiments, phased array antenna 100 includes at least one variable impedance 124 disposed within resonant cavity 106, e.g., on side walls of resonant cavity 106, to modify cavity mode boundary conditions within resonant cavity 106. In certain embodiments, phased array antenna 100 includes a plurality of variable impedances (not shown) respectively coupled with the plurality of feed waveguides 112 to modify cavity mode boundary conditions for resonant cavity 106. In certain alternative embodiments, phased array antenna 100 further includes a polarizer (not shown) configured to apply, for example, a circular polarization to the radiated beam.

Figure 3:
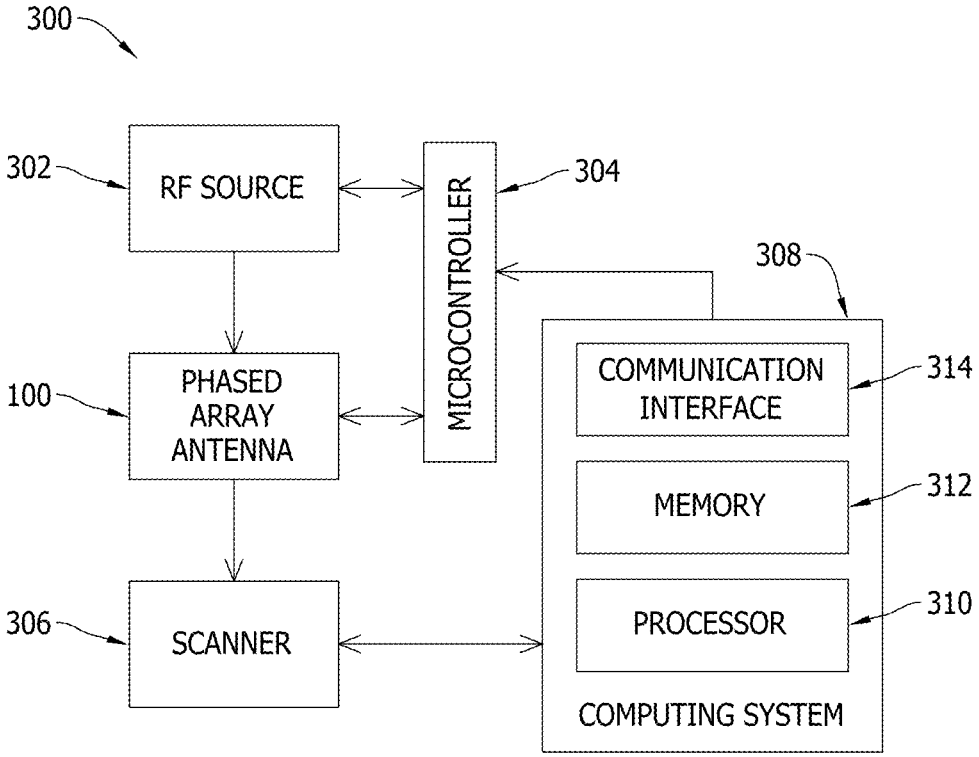
FIG. 3 is a block diagram of an example system for steering a beam radiated from the phased array antenna shown in FIGS. 1 and 2.

FIG. 3 is a block diagram of a system 300 for steering a beam radiated from phased array antenna 100 (shown in FIGS. 1 and 2). Phased array antenna 100 is fed by an RF source 302 and controlled by a microcontroller 304. Microcontroller 304 controls, for example, each of the plurality of phase shifters 120 (shown in FIG. 2) of phased array antenna 100 independently to modify the respective phase shifts applied to the RF signal supplied by RF source 302. Further, in certain embodiments, microcontroller 304 is configured to control RF source 302 to modify, for example, the amplitude, frequency, or phase of the original electromagnetic waves supplied to feed waveguides 112 (shown in FIGS. 1 and 2).

RF source 302 can include one or more RF circuits or components, such as, for example, a modulator, amplifier, oscillator, or other wave generator. The electromagnetic waves generated by RF source 302 are inserted into feed waveguides 112 where they propagate to resonant cavity 106. Along the path to resonant cavity 106, the electromagnetic waves are phase shifted and, in certain embodiments, attenuated.

System 300 includes a scanner 306 configured to measure electromagnetic fields within resonant cavity 106 relative to the array of slot antenna elements 108. Scanner 306 can include, for example, a planar scanner for testing near-field radiation performance from phased array antenna 100, including, for example, gain and current density.

System 300 includes a computing system 308 communicatively coupled to scanner 306 and to microcontroller 304. Computing system 308 includes a processor 310, a memory 312, and a communication interface 314. Processor 310 is configured to execute instructions, or program code, stored in memory 312 or any other suitable local or remote memory device. Processor 310, for example, is configured to gain access to program code for receiving, via communication interface 314, and processing test data collected by scanner 306 for phased array antenna 100. Such test data can be stored, for example in memory 312. Processor 310 is further configured to gain access to program code for instructing microcontroller 304, via communication interface 314, to independently control phase shifters 120 (shown in FIG. 2) to sweep through a range of phases for electromagnetic waves to be fed to phased array antenna 100 to steer the beam. Computing system 308 instructs both scanner 306 and microcontroller 304 to collect test data for each permutation of phases within the range among phase shifters 120. The resolution of each step through the range of phases can be selected to correspond to the steering resolution of phased array antenna 100. For example, in one embodiment, each phase shifter 120 sweeps through the range in 10 degree increments. In alternative embodiments, each phase shifter 120 sweeps through the range in 5 degree increments.

Processor 310 is further configured to gain access to program code for processing the test data collected by scanner 306 to determine a beam direction in azimuth and elevation relative to boresight 102 corresponding to electromagnetic fields measured by the scanner for each permutation of phase settings for phase shifters 120. In certain embodiments, scanner 306 maps measured current densities to the array of slot antenna elements 108. Then processor 310, in certain embodiments, is further configured to correlate the measured current densities to the beam directions.

Processor 310 is further configured to build a look-up table that relates the range of phases to beam directions. The look-up table can then be loaded onto microcontroller 304 such that it can control phase shifters 120 to produce a pattern of electromagnetic waves within resonant cavity 106 that correspond to a desired beam direction. For example, microcontroller 304 can be programmed, or configured, to index into the look-up table based on the desired beam direction, in azimuth and elevation relative to boresight, and retrieve respective phase settings upon which control of the phase shifters by microcontroller 304 is based.

Figure 4:
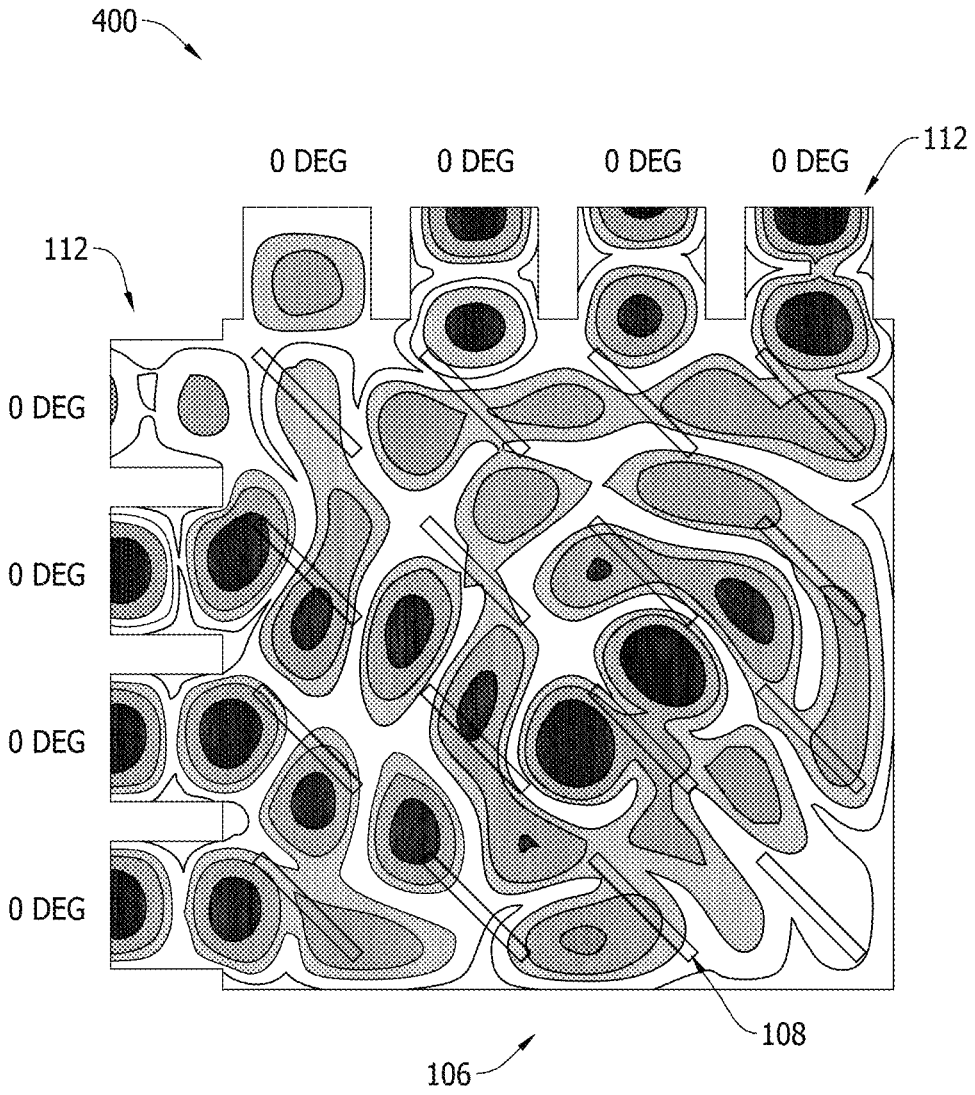
FIG. 4 is an example current density map for a boresight beam.
Figure 5:
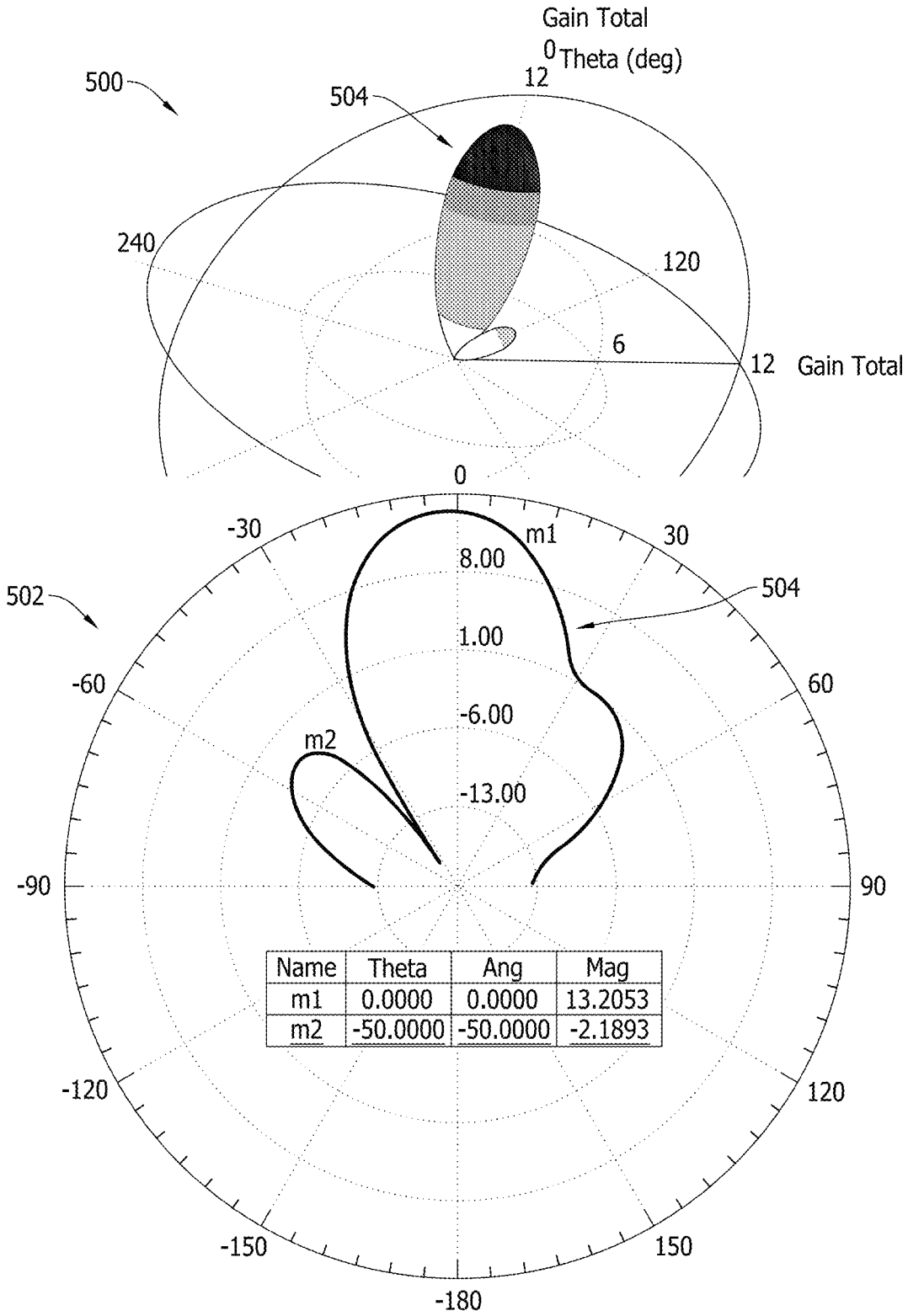
FIG. 5 is a plot of example Smith charts corresponding to the current density map shown in FIG. 4 and illustrating a steered beam in azimuth and elevation.

FIG. 4 is an example current density map 400 produced by scanner 306 when all phase shifters on each of feed waveguides 112 are set to zero degrees phase shift. FIG. 5 is a plot of example Smith charts 500 and 502 corresponding to current density map 400 shown in FIG. 4 and illustrating a steered beam 504 in the form of a directed gain. FIGS. 4 and 5 together show the beam radiated by phased array antenna 100 with such phase shifter settings is steered to boresight 102, or in the Z-axis direction. Current density map 400 shows current densities mapped over boresight surface 104 and the plurality of slot antenna elements 108. Peak current densities (shown as the more intense and darker shading in FIG. 4) represent amplitudes of the standing waves produced within resonant cavity 106. Smith chart 500 illustrates steered beam 504, or the highest gain, directed toward boresight elevation, or a Theta of zero. Likewise, Smith chart 502 illustrates an azimuth of zero degrees with respect to boresight 102. Accordingly, system 300 (shown in FIG. 3) would include in its look-up table phase shifter settings of zero degrees for a beam directed toward boresight 102.

Figure 6:
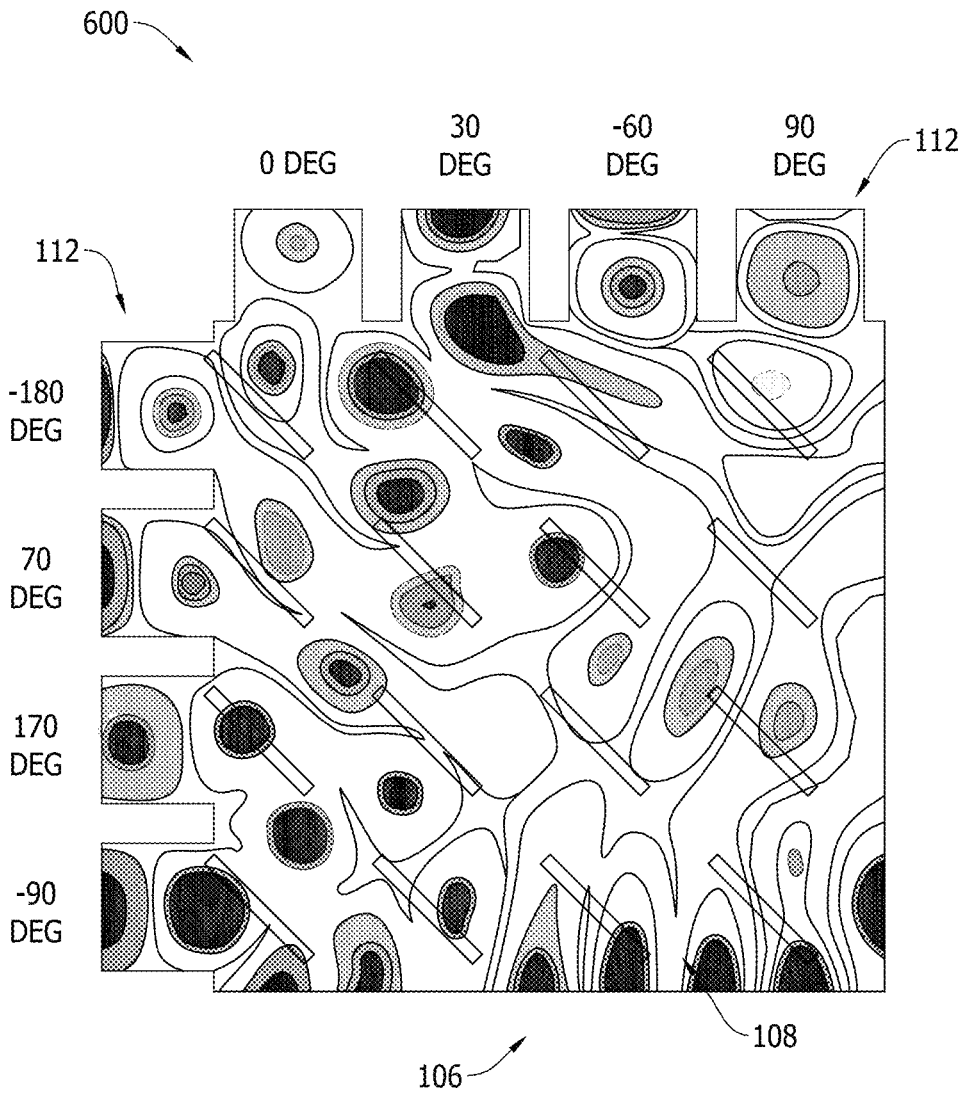
FIG. 6 is another example current density map for a steered beam.
Figure 7:
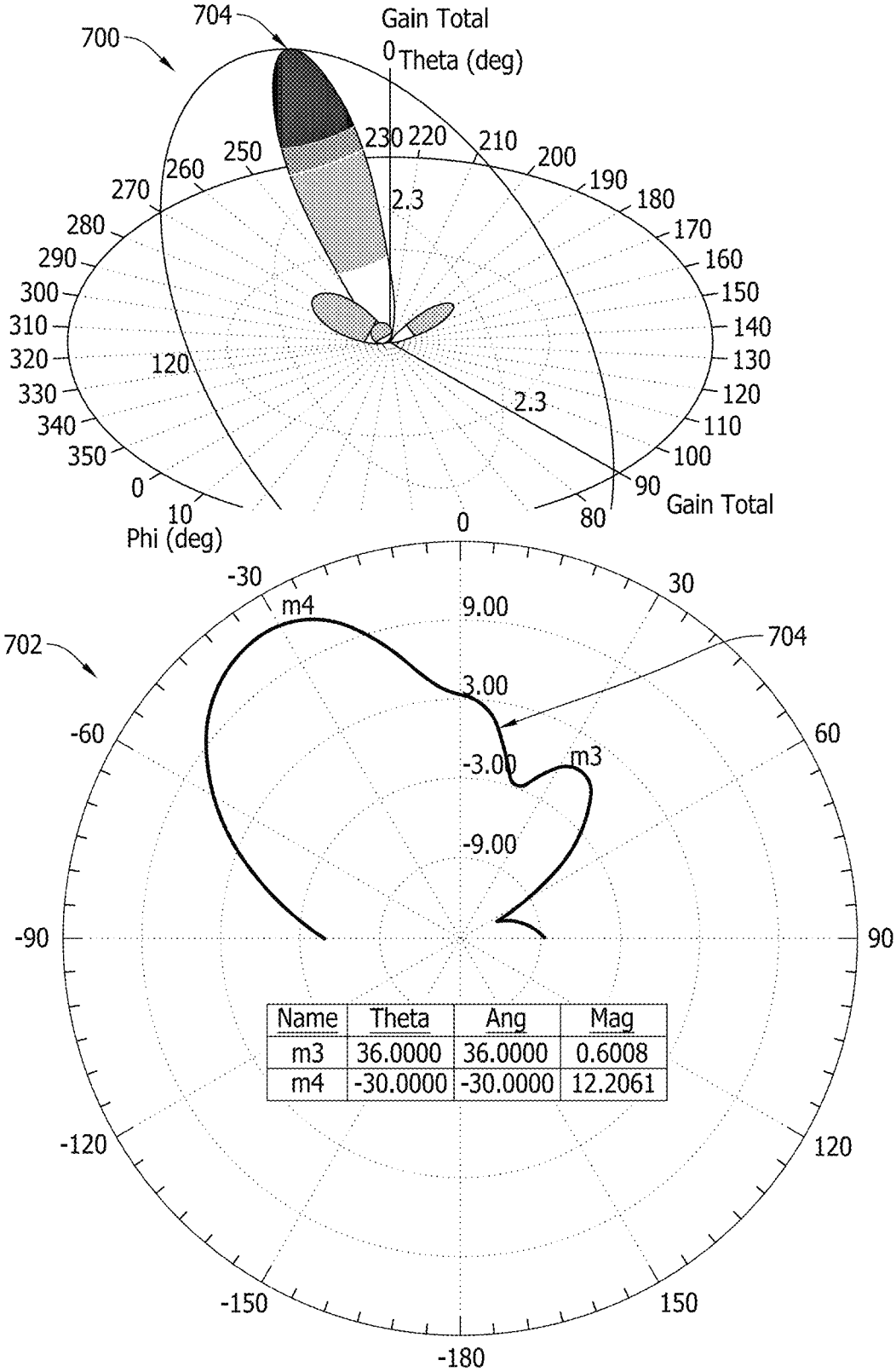
FIG. 7 is a plot of example Smith charts corresponding to the current density map shown in FIG. 6 and illustrating a steered beam in azimuth and elevation.

FIG. 6 is another example current density map 600 produced by scanner 306 when respective phase shifters 120 on each of feed waveguides 112 are set to the shown phase settings in degrees (clockwise from lower left: −90, 170, 70, −180, 0, 30, −60, 90) relative to boresight 102. FIG. 7 is a plot of example Smith charts 700 and 702 corresponding to current density map 600 shown in FIG. 6 and illustrating a steered beam 704 in the form of a directed gain. FIGS. 6 and 7 together show the beam radiated by phased array antenna 100 with such phase shifter settings is steered to −30 degrees azimuth and −30 degrees elevation relative to boresight 102. Current density map 600 shows current densities mapped over boresight surface 104 and the plurality of slot antenna elements 108. Peak current densities (shown as the more intense and darker shading in FIG. 6) represent amplitudes of the standing waves produced within resonant cavity 106. Smith chart 700 illustrates steered beam 704, or the highest gain, having an elevation of −30 degrees, or Theta=−30 degrees. Likewise, Smith chart 702 illustrates an azimuth of −30 degrees with respect to boresight 102. Accordingly, system 300 (shown in FIG. 3) would include in its look-up table the shown phase shifter settings for a beam directed toward −30 degrees azimuth and −30 degrees elevation relative to boresight 102.

Figure 8:
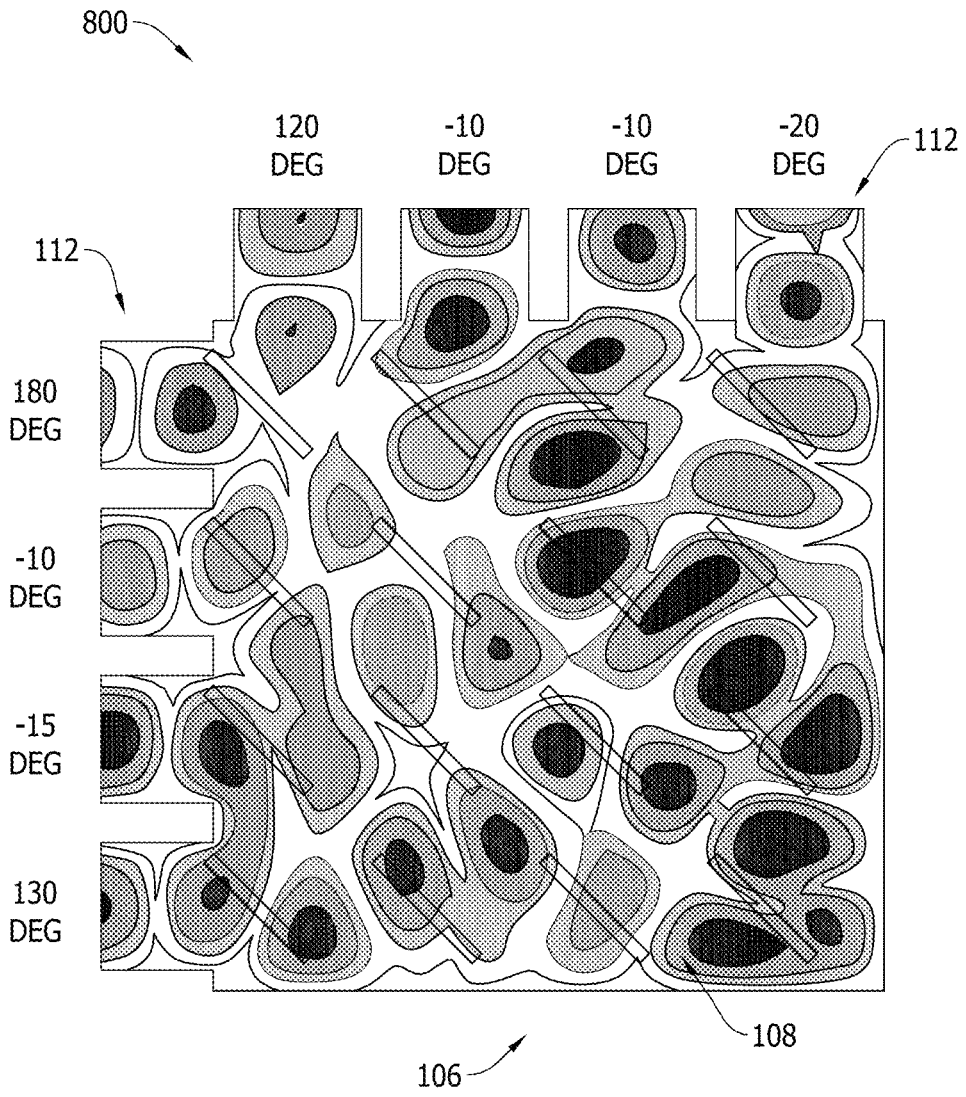
FIG. 8 is another example current density map for a steered beam.
Figure 9:
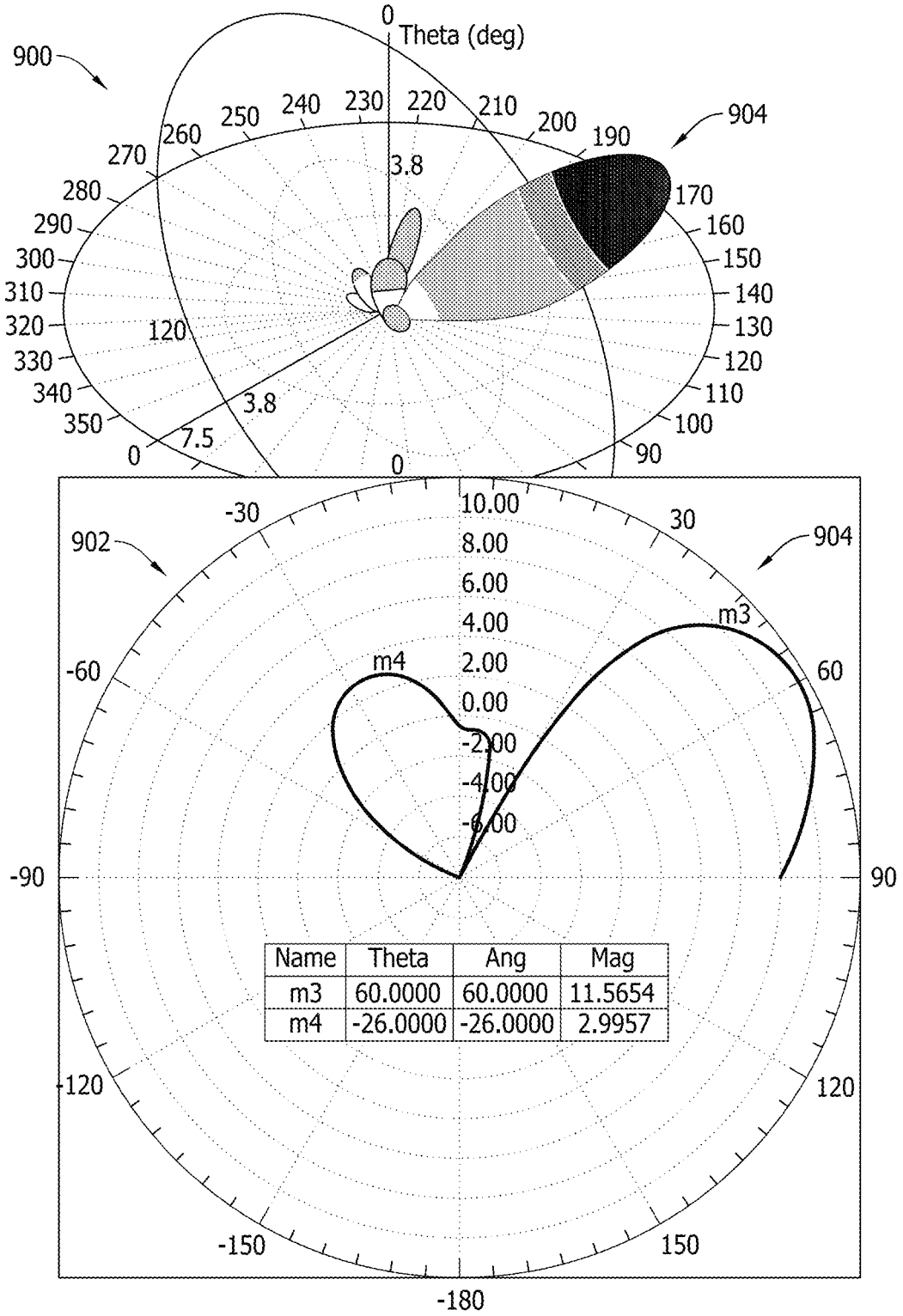
FIG. 9 is a plot of example Smith charts corresponding to the current density map shown in FIG. 8 and illustrating a steered beam in azimuth and elevation.

FIG. 8 is another example current density map 800 produced by scanner 306 when respective phase shifters 120 on each of feed waveguides 112 are set to the shown phase settings in degrees (clockwise from lower left: 130, −15, −10, 180, 120, −10, −10, −20) relative to boresight 102. FIG. 9 is a plot of example Smith charts 900 and 902 corresponding to current density map 800 shown in FIG. 8 and illustrating a steered beam 904 in the form of a directed gain. FIGS. 8 and 9 together show the beam radiated by phased array antenna 100 with such phase shifter settings is steered to 60 degrees azimuth and 60 degrees elevation relative to boresight 102. Current density map 800 shows current densities mapped over boresight surface 104 and the plurality of slot antenna elements 108. Peak current densities (shown as the more intense and darker shading in FIG. 8) represent amplitudes of the standing waves produced within resonant cavity 106. Smith chart 900 illustrates steered beam 904, or the highest gain, having an elevation of 60 degrees, or Theta=60 degrees. Likewise, Smith chart 902 illustrates an azimuth of 60 degrees with respect to boresight 102. Accordingly, system 300 (shown in FIG. 3) would include in its look-up table the shown phase shifter settings for a beam directed toward 60 degrees azimuth and 60 degrees elevation relative to boresight 102.

In alternative embodiments, the locations of standing waves within resonant cavity 106 can be computed, by computing system 300 and/or by microcontroller 304, based on respective phase settings for phase shifters 120. The computed standing waves can then be correlated to a beam direction. The relationship between phase settings for phase shifters 120 and beam direction can be recorded in a look-up table as described above, or microcontroller 304 can compute the phase settings for a given beam direction during operation, or on the fly. Deterministically computing phase settings for phase shifters 120 in a large phased array antenna is generally computationally intense, making it more feasible to test phased array antenna 100 using scanner 306 and computing system 300 as described above to build a look-up table.

Figure 10:
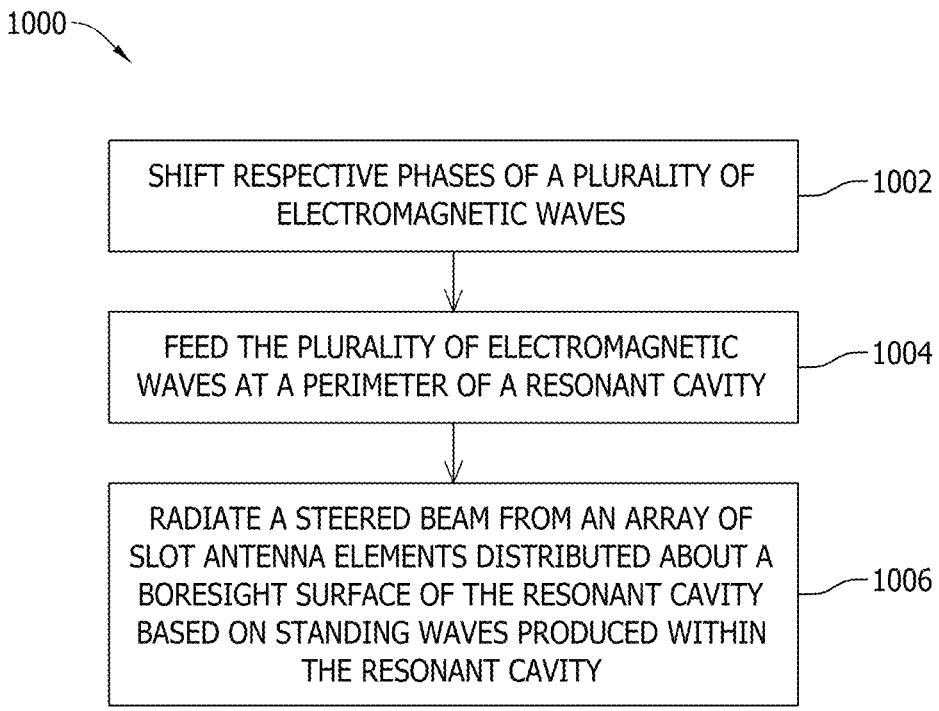
FIG. 10 is a flow diagram for an example method of beam steering using the phased array antenna shown in FIGS. 1-3.

FIG. 10 is a flow diagram of an example method 1000 of beam steering using phased array antenna 100 (shown in FIGS. 1, 2, and 3). Generally, electromagnetic waves are generated at an RF source such as RF source 302 (shown in FIG. 3). Method 1000 includes shifting 1002 respective phases of a plurality of electromagnetic waves, and then feeding 1004 the plurality of electromagnetic waves through feed waveguides 112 at a perimeter of resonant cavity 106, e.g., sides 114 and 116. Resonant cavity 106 is configured to produce standing waves within resonant cavity 106 based on the electromagnetic waves fed into it.

Generally, shifting 1002 respective phases includes, for an N-by-M array of slot antenna elements 108, shifting respective phases of N+M electromagnetic waves fed to the perimeter of resonant cavity 106 using no more than N+M phase shifters 120. Phase shifting 1002 can be achieved, in certain embodiments, by independently controlling the plurality of phase shifters 120 coupled with corresponding feed waveguides 112 to modify respective phases of standing waves within resonant cavity 106.

Method 1000 includes radiating 1006 a steered beam from the array of slot antenna elements 108 distributed about boresight surface 104 of resonant cavity 106. The radiated beam is based on the standing waves in resonant cavity 106.

In certain embodiments, method 1000 includes attenuating the plurality of electromagnetic waves fed to the perimeter of resonant cavity 106 to control amplitude of the standing waves. In certain embodiments, method 1000 includes varying at least one impedance disposed within resonant cavity 106, such as impedance 124, to modify cavity mode boundary conditions for resonant cavity 106. In certain embodiments, method 1000 further includes varying a plurality of variable impedances respectively coupled with corresponding feed waveguides 112 to the perimeter of resonant cavity 106 to modify cavity mode boundary conditions for resonant cavity 106.

The technical effects of embodiments of the systems and methods described herein include, for example: (a) forming a phased array antenna using a resonant cavity and an array of slot antenna elements; (b) feeding a phased array antenna at a perimeter rather than element-by-element; (c) reducing the quantity of feeds and phase shifters necessary to steer a beam radiated by a phased array antenna; (d) reducing complexity and cost of phased array antennas by using a perimeter fed resonant cavity; (e) enabling larger phased array antennas due to feeds being concentrated on two sides of the resonant cavity; and (f) independently controlling phase shifters for a perimeter-fed resonant cavity based on a mapping of phase settings to beam direction to modify phases of standing waves produced within the resonant cavity to steer the beam.

Generally, waveguides have a shape and dimensions that define the range of signals (e.g., frequency and mode) that will propagate through a given waveguide. Feed waveguides 112, for example, can include a circular or rectangular waveguide, or any other shape of waveguide. Generally, waveguides are dimensioned for microwave signals, or signals having a frequency between about 300 Megahertz (MHz) and about 300 Gigahertz (GHz). Accordingly, an RF antenna can also be referred to as a microwave antenna. For example, a waveguide can be dimensioned for an operating frequency of 20 GHz. Likewise, microstrip transmission lines, slot antenna elements, resonant cavities, phase shifters, and attenuators are designed for efficient signal propagation (or suppression in the case of attenuators) at the desired operating frequency, and are further designed for impedance matching at, for example, transitions from a waveguide to a resonant cavity. As another example, slot antenna elements generally have a length and width corresponding to the desired operating frequency. Further, the orientation of apertures for slot antenna elements is selected for efficient signal propagation for the desired operating frequency.

Some embodiments involve the use of one or more electronic processing or computing devices. As used herein, the terms "processor" and "computer" and related terms, e.g., "processing device," "computing device," and "controller" are not limited to just those integrated circuits referred to in the art as a computer, but broadly refers to a processor, a processing device, a controller, a general purpose central processing unit (CPU), a graphics processing unit (GPU), a microcontroller, a microcomputer, a programmable logic controller (PLC), a reduced instruction set computer (RISC) processor, a field programmable gate array (FPGA), a digital signal processing (DSP) device, an application specific integrated circuit (ASIC), and other programmable circuits or processing devices capable of executing the functions described herein, and these terms are used interchangeably herein. The above embodiments are examples only, and thus are not intended to limit in any way the definition or meaning of the terms processor, processing device, and related terms.

In the embodiments described herein, memory can include, but is not limited to, a non-transitory computer-readable medium, such as flash memory, a random access memory (RAM), read-only memory (ROM), erasable programmable read-only memory (EPROM), electrically erasable programmable read-only memory (EEPROM), and non-volatile RAM (NVRAM). As used herein, the term "non-transitory computer-readable media" is intended to be representative of any tangible, computer-readable media, including, without limitation, non-transitory computer storage devices, including, without limitation, volatile and non-volatile media, and removable and non-removable media such as a firmware, physical and virtual storage, CD-ROMs, DVDs, and any other digital source such as a network or the Internet, as well as yet to be developed digital means, with the sole exception being a transitory, propagating signal. Alternatively, a floppy disk, a compact disc—read only memory (CD-ROM), a magneto-optical disk (MOD), a digital versatile disc (DVD), or any other computer-based device implemented in any method or technology for short-term and long-term storage of information, such as, computer-readable instructions, data structures, program modules and sub-modules, or other data may also be used. Therefore, the methods described herein may be encoded as executable instructions, e.g., "software" and "firmware," embodied in a non-transitory computer-readable medium. Further, as used herein, the terms "software" and "firmware" are interchangeable, and include any computer program stored in memory for execution by personal computers, workstations, clients and servers. Such instructions, when executed by a processor, cause the processor to perform at least a portion of the methods described herein. The systems and methods described herein are not limited to the specific embodiments described herein, but rather, components of the systems and/or steps of the methods may be utilized independently and separately from other components and/or steps described herein.

The systems and methods described herein are not limited to the specific embodiments described herein, but rather, components of the systems and/or steps of the methods may be utilized independently and separately from other components and/or steps described herein.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

As used herein, an element or step recited in the singular and proceeded with the word "a" or "an" should be understood as not excluding plural elements or steps unless such exclusion is explicitly recited. Further, references to "one embodiment" of the present disclosure or "an example embodiment" are not intended to be interpreted as excluding the existence of additional embodiments that also incorporate the recited features. Furthermore, to the extent the terms "includes," "including," "has," "contains," and variants thereof are used herein, such terms are intended to be inclusive in a manner similar to the term "comprises" as an open transition word without precluding any additional or other elements.

This written description uses examples to disclose various embodiments, which include the best mode, to enable any person skilled in the art to practice those embodiments, including making and using any devices or systems and performing any incorporated methods. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A phased array antenna comprising:

a resonant cavity comprising a boresight surface having a normal vector oriented with boresight for the phased array antenna;

a plurality of feed waveguides distributed along a perimeter of the resonant cavity and configured to supply respective electromagnetic waves to the resonant cavity;

an array of slot antenna elements distributed about the boresight surface and configured to radiate a beam based on standing waves within the resonant cavity; and a plurality of phase shifters respectively coupled with the plurality of feed waveguides and independently controllable to modify the respective phases of the standing waves to steer the beam.

2. The phased array antenna of claim 1, wherein the array of slot antenna elements comprises an N-by-M array of slot antenna elements, where N and M are each integers greater than one, and wherein the plurality of feed waveguides and the plurality of phase shifters comprise no more than N+M phase shifters respectively coupled with N+M feed waveguides.

3. The phased array antenna of claim 1 further comprising a plurality of attenuators respectively coupled with the plurality of feed waveguides to control respective amplitudes of the standing waves.

4. The phased array antenna of claim 1 further comprising a dielectric material disposed within the resonant cavity.

5. The phased array antenna of claim 1 further comprising at least one variable impedance disposed within the resonant cavity to modify cavity mode boundary conditions for the resonant cavity.

6. The phased array antenna of claim 1 further comprising a plurality of variable impedances respectively coupled with the plurality of feed waveguides to modify cavity mode boundary conditions for the resonant cavity.

7. The phased array antenna of claim 1, wherein the array of slot antenna elements are spaced from each other by one-half wavelength (lambda/2) of an operating frequency for the phased array antenna.

8. A method comprising:

shifting respective phases of a plurality of electromagnetic waves;

feeding the plurality of electromagnetic waves only at a perimeter of a resonant cavity, the resonant cavity configured to produce standing waves therein based on the electromagnetic waves, wherein feeding comprises propagating the plurality of electromagnetic waves through corresponding feed waveguides; and radiating a steered beam from an array of slot antenna elements distributed about a boresight surface of the resonant cavity based on the standing waves.

9. The method of claim 8, wherein the array of slot antenna elements comprises an N-by-M array of slot antenna elements, where N and M are each integers greater than one, and wherein shifting the respective phases of the plurality of electromagnetic waves comprises shifting respective phases of N+M electromagnetic waves fed to the perimeter of the resonant cavity using no more than N+M phase shifters.

10. The method of claim 8, wherein shifting the respective phases comprises independently controlling a plurality of phase shifters coupled with the corresponding feed waveguides to modify the respective phases of the standing waves to steer the steered beam.

11. The method of claim 10 further comprising:

measuring, by a scanner, electromagnetic fields within the resonant cavity relative to the array of slot antenna elements for the respective phases; and building, by a computing system in communication with the scanner, a look up table relating the respective phases to beam directions corresponding to electromagnetic fields measured by the scanner.

12. The method of claim 8 further comprising attenuating the plurality of Electromagnetic waves fed to the perimeter of the resonant cavity.

13. The method of claim 8 further comprising varying at least one impedance disposed within the resonant cavity to modify cavity mode boundary conditions for the resonant cavity.

14. The method of claim 8 further comprising varying a plurality of variable impedances respectively coupled with corresponding feed waveguides to the perimeter of the resonant cavity to modify cavity mode boundary conditions for the resonant cavity.

15. A system for steering a beam radiated from a phased array antenna, the system comprising:

a phased array antenna comprising:

a resonant cavity, an array of slot antenna elements distributed about a boresight surface and configured to radiate a beam based on standing waves within the resonant cavity, and a plurality of phase shifters coupled with corresponding feed waveguides at a perimeter of the phased array antenna, the plurality of phase shifters each independently controllable to sweep through a range of phases for electromagnetic waves fed to the phased array antenna to steer the beam;

a scanner configured to measure electromagnetic fields within the resonant cavity relative to the array of slot antenna elements for the range of phases; and a computing system in communication with the scanner and configured to build a look up table relating the range of phases to beam directions corresponding to electromagnetic fields measured by the scanner.

16. The system of claim 15, wherein the array of slot antenna elements comprises an N-by-M array of slot antenna elements, and wherein the plurality of phase shifters comprises N+M phase shifters.

17. The system of claim 15, wherein the scanner is further configured to map measured current densities to the array of slot antenna elements.

18. The system of claim 17, wherein the computing system is further configured to correlate the measured current densities to the beam directions.

19. The system of claim 15 further comprising a processing device coupled to the plurality of phase shifters and configured to control the phase shifters to produce a pattern of electromagnetic waves within the resonant cavity that correspond to a desired beam direction.

20. The system of claim 19, wherein the processing device is further configured to index into the look up table based on the desired beam direction and retrieve respective phase settings upon which control of the phase shifters by the processing device is based.

* * * * *